US006337546B1

(12) United States Patent
Inoue

(10) Patent No.: US 6,337,546 B1
(45) Date of Patent: Jan. 8, 2002

(54) METHOD OF MOUNTING ELECTRODE FOR OUTPUTTING SIGNAL GENERATED IN CATHODE RAY TUBE, SIGNAL OUTPUTTING METHOD IN CATHODE RAY TUBE, AND CATHODE RAY TUBE

(75) Inventor: Takahiro Inoue, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/593,167

(22) Filed: Jun. 14, 2000

(30) Foreign Application Priority Data

Jun. 15, 1999 (JP) ..... P11-167982

(51) Int. Cl.[7] ..... G09G 1/04

(52) U.S. Cl. ..... 315/410; 315/368.16; 315/368.15; 315/3; 313/477 R; 313/481

(58) Field of Search ..... 315/364, 368.16, 315/368.15, 369–371, 410, 411, 3; 313/477 R, 479, 481

(56) References Cited

U.S. PATENT DOCUMENTS 4,101,803 A * 7/1978 Retsky et al. ..... 315/3
5,396,156 A * 3/1995 Iguchi et al. ..... 315/368.15
5,428,269 A * 6/1995 Hedrick ..... 315/369
5,539,278 A * 7/1996 Takahashi ..... 315/14

FOREIGN PATENT DOCUMENTS

JP 11-072658 3/1999

* cited by examiner

*Primary Examiner*—Haissa Philogene
(74) *Attorney, Agent, or Firm*—Rader, Fishman & Grauer PLLC; Ronald P. Kananen

(57) ABSTRACT

A method of mounting a signal outputting electrode for outputting an electric signal generated in an envelope of a cathode ray tube to the outside without being adversely influenced by a getter. A signal outputting electrode is mounted in an area which is not covered with an internal conductive film in a state where the periphery of the electrode is apart from an inner wall of a funnel via an intermediate member. When a getter is introduced into the tube in the state where the signal outputting electrode is mounted, the getter is prevented from reaching the intermediate member. It therefore prevents conduction between the signal outputting electrode and the inner conductive film.

17 Claims, 14 Drawing Sheets

TH2
TH1 tm
tm tb

S1L
S1R
ti tg
tg
tg
tg 61
62

FIG.14A
FIG.14B
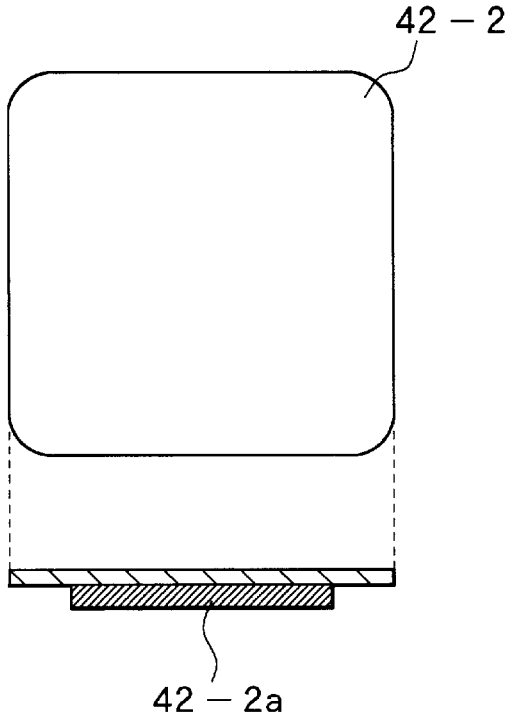
FIG.15A
FIG.15B
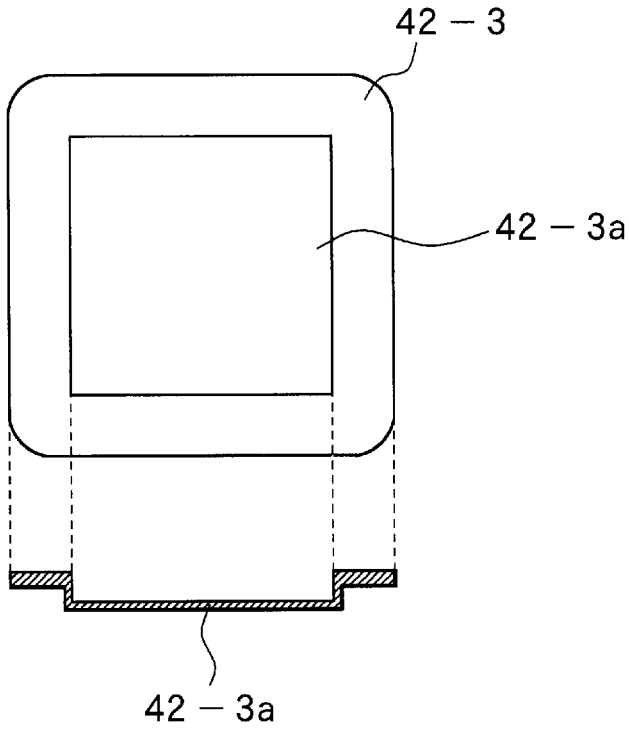

METHOD OF MOUNTING ELECTRODE FOR OUTPUTTING SIGNAL GENERATED IN CATHODE RAY TUBE, SIGNAL OUTPUTTING METHOD IN CATHODE RAY TUBE, AND CATHODE RAY TUBE

BACKGROUND OF THE INVENTION

1. Field of the Invention

The present invention relates to a signal outputting method of outputting an electric signal generated in an envelope constructing a cathode ray tube to the outside of the envelope, a method of mounting a signal outputting electrode for outputting the electric signal to the outside of the envelope, and a cathode ray tube having the function of outputting the electric signal to the outside of the envelope.

2. Description of the Related Art

In an image display apparatus such as a television receiver or a monitor for a computer, for example, a cathode ray tube (CRT) is widely used. In the CRT (hereinbelow, also simply called a "tube"), an electron beam is emitted from an electron gun provided therein onto a fluorescent screen and an image is formed according to a scan with the electron beam. The CRT generally comprises a panel in which a fluorescent screen is formed and a funnel provided integrally with the panel. In the rear part of the funnel of the CRT, an elongated neck having therein an electron gun is formed. The inner surface from the neck to the fluorescent screen of the panel is covered with an inner conductive film, electrically connected to the anode, and is maintained at a high voltage. The external view of the CRT as a whole is a funnel shape formed by the panel, funnel, and neck. In the following description, the whole portion of the CRT formed by the panel and the funnel will be also called an "envelope".

In the CRT, there is a case such that an electric signal generated in the tube (that is, in the envelope) is desired to be outputted to the outside of the CRT (that is, the outside of the envelope which will be also simply called "outside of the tube"). For example, the applicant of the invention has disclosed a CRT in Japanese Patent Application No. 11-72658 in which detecting means for generating a detection signal according to an incident electron beam is provided in an overscan area of an electron beam in the tube. According to the invention, a detection signal generated by the detecting means in the tube is outputted to the outside of the tube and is used, for example, for controlling the scan position of an electron beam. In the invention, for example, by mounting signal outputting electrodes directly on the inner and outer walls of the envelope so as to face each other, a capacitor using a part of the envelope as a dielectric is formed. By electrically connecting the electron beam detecting means to the capacitor, the detection signal generated by the detecting means is outputted to the outside of the envelope. The electrode mounted on the inner wall of the envelope is insulated from an inner conductive film formed in the tube.

On the other hand, the manufacturing process of the CRT includes a so-called gettering process for introducing a substance such as an active metal called a getter (for example, barium) into the tube so that unnecessary gases are absorbed by the getter, thereby maintaining a high vacuum state in the tube. In the method of mounting the signal outputting electrode, however, it is feared that the getter introduced in the gettering process is adhered to the periphery of the electrode mounted on the inner wall of the envelope and the signal outputting electrode and the inner conductive film formed in the tube are made conductive.

When the inner conductive film and the signal outputting electrode are made conductive, there is the possibility that the detection signal generated in the envelope cannot be accurately outputted to the outside. It is therefore desirable to mount the electrode in consideration of the gettering process.

SUMMARY OF THE INVENTION

The invention has been achieved in consideration of the problem and a first object of the invention is to provide a signal outputting electrode mounting method capable of mounting a signal outputting electrode for outputting an electric signal generated in an envelope of a cathode ray tube to the outside without being adversely influenced by a getter.

A second object of the invention is to provide a method of outputting a signal in a cathode ray tube and a cathode ray tube, which can excellently outputting an electric signal generated in the envelope of the cathode ray tube to the outside of the tube without being adversely influenced by a getter.

According to a method of mounting a signal outputting electrode in a cathode ray tube of the invention, a signal outputting electrode for outputting an electric signal generated in an envelope of the cathode ray tube to the outside of the envelope is mounted onto an inner wall of the envelope in a state where at least the periphery of the signal outputting electrode is apart from the inner wall of the envelope.

According to a signal outputting method in a cathode ray tube of the invention, a signal outputting electrode for outputting an electric signal generated in an envelope of the cathode ray tube is mounted onto an inner wall of the envelope in a state where at least the periphery of the electrode is apart from the inner wall of the envelope, and the electric signal generated in the envelope is outputted to the outside of the envelope via the signal outputting electrode mounted on the inner wall of the envelope.

A cathode ray tube according to the invention comprises: an envelope; a light emitting portion for emitting light in accordance with a scan with an electron beam emitted in the envelope; and a signal outputting electrode which is mounted on an inner wall of the envelope in such a manner that at least the periphery is apart from the inner wall of the envelope and which outputs an electric signal generated in the envelope to the outside of the envelope.

According to a method of mounting a signal outputting electrode of the invention, a signal outputting electrode is mounted onto an inner wall of an envelope in a state where at least the periphery of the electrode is apart from the inner wall of the envelope.

According to the signal outputting method and the cathode ray tube in the invention, an electric signal generated in an envelope is outputted to the outside of the envelope via a signal outputting electrode mounted in a state where at least the periphery of the electrode is apart from the inner wall of the envelope.

Others and further objects, features and advantages of the invention will appear more fully from the following description.

BRIEF DESCRIPTION OF THE DRAWINGS

FIGS. 14A and 14B are plan view and cross section showing further another example of the construction of the signal outputting electrode.

FIGS. 15A and 15B are plan view and cross section showing further another example of the construction of the signal outputting electrode.

DETAILED DESCRIPTION OF THE PREFERRED EMBODIMENTS

Figure 1A:
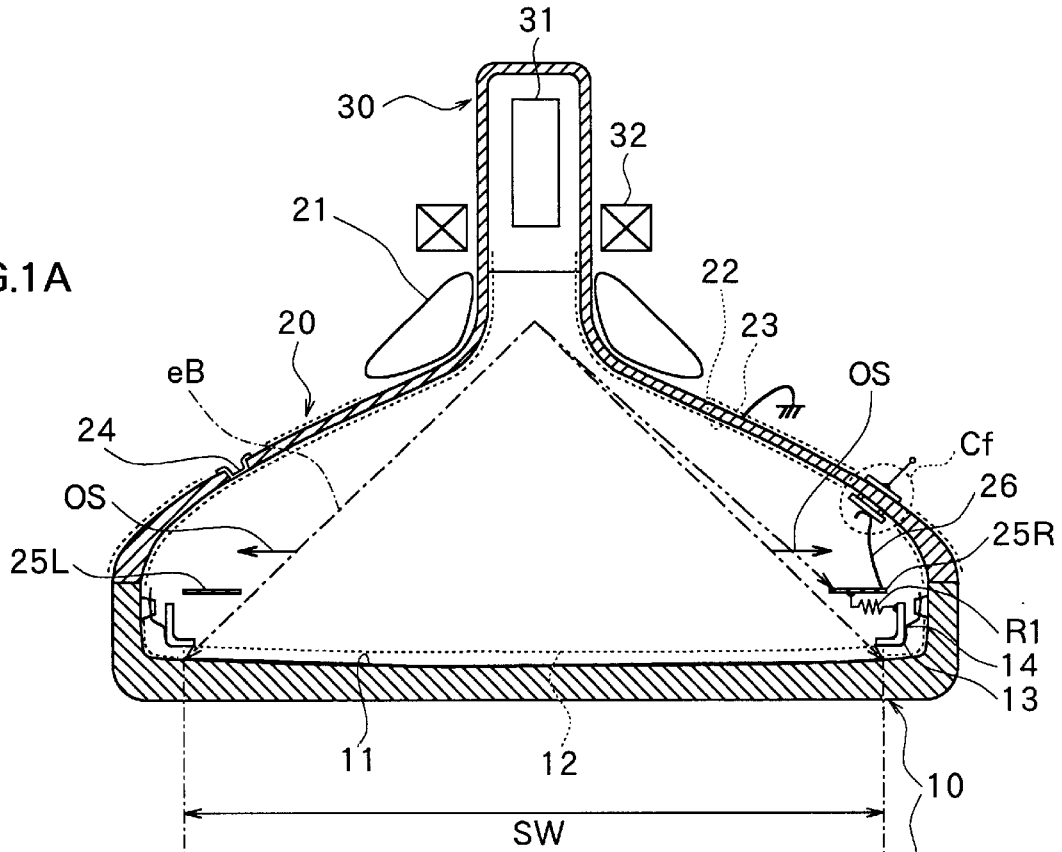
FIG. 1, consisting of FIGS. 1A and 1B schematically shows the configuration of a CRT according to a first embodiment of the invention together with an example of a scanning direction of an electron beam.

Embodiments of the invention will be described in detail hereinbelow by referring to the drawings.

[First Embodiment]

Figure 1B:
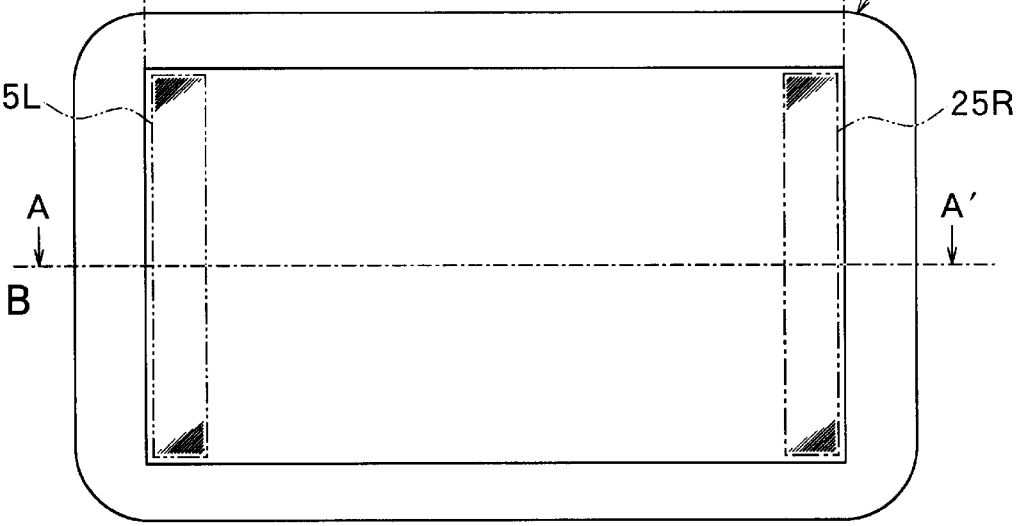

FIG. 1B is a front view of the CRT. FIG. 1A is a cross section taken along line A–A' of FIG. 1B. The CRT according to the embodiment comprises a panel 10 in which a fluorescent screen 11 is formed and a funnel 20 integrally formed with the panel 10. In the rear end of the funnel 20, an elongated neck 30 having therein an electron gun 31 is formed. The funnel shape in external view of the CRT as a whole is formed by the panel 10, the funnel 20, and the neck 30. In the embodiment, the portion corresponding to the whole shape of the cathode ray tube will be called an "envelope". The opening part of the panel 10 and that of the funnel 20 are adhered to each other by melting and a high vacuum state can be maintained on the inside. A stripe pattern (not shown) made by phosphors is formed on the fluorescent screen 11. The fluorescent screen 11 corresponds to an example of "light emitting plane" in the invention.

In the CRT (that is, in the envelope), a color selecting mechanism 12 made by a metal thin plate is disposed so as to face the fluorescent screen 11. The color selecting mechanism 12 is an aperture grille, a shadow mask, or the like in accordance with the system. The periphery of the color selecting mechanism 12 is supported by a frame 13 and is attached to the inner face of the panel 10 via a supporting spring 14. The funnel 20 has an anode 24 to which an anode voltage HV is applied. On the periphery of the funnel 20 and the neck 30, a deflection yoke 21 for deflecting an electron beam eB emitted from the electron gun 31 and a convergence yoke 32 for converging the electron beams eB for respective colors emitted from the electron gun 31 are attached. The inner face from the neck 30 to the fluorescent screen 11 of the panel 10 is covered with an inner conductive film 22. The inner conductive film 22 is electrically connected to the anode 24 and is maintained at the anode voltage HV of a high potential. The outer peripheral face of the funnel 20 is covered with an external conductive film 23.

Although not shown, the electron gun 31 has a construction in which a plurality of electrodes (grids) are arranged in the front part of a hot cathode structure having three cathodes (hot cathodes) for red (R), green (G) and blue (B). By each of the electrodes, control, acceleration, and the like of the electron beam eB emitted from the cathode is performed. The electron beam eB for each color emitted from the electron gun 31 passes through the color selecting mechanism 12 and the like and hits a phosphor of a corresponding color on the fluorescent screen 11.

On both sides in the CRT, right index electrode 25R and a left index electrode 25L each having a rectangular plate shape (hereinbelow, the two electrodes 25R and 25L will be also collectively called "index electrodes 25") are provided. The index electrodes 25 are provided in overscan areas in the horizontal direction of the electron beam eB in the tube so as to face the fluorescent screen 11 and generate electric detection signals according to the incident electron beam eB. The detection signal generated from the index electrode 25 is supplied to a processing circuit for image correction outside of the tube (that is, outside of the envelope) and is used mainly for the control of the scan position of the electron beam eB. In the embodiment, the overscan area denotes the area outside of an area of the effective screen in the scan area of the electron beam eB. In FIG. 1, an area SW corresponds to an effective screen on the fluorescent screen 11 in the horizontal direction and an area OS is an overscan area in the horizontal direction.

The index electrodes 25R and 25L correspond to an example of "electron beam detecting means" in the invention.

The index electrode 25 is made of a conductive substance such as a metal. For example, the index electrode 25 is suspended via an insulating material (not shown) by using the frame 13 for supporting the color selecting mechanism 12 as a base. The index electrode 25 is electrically connected to a resistor R1 attached to the frame 13. The anode voltage HV is applied to the index electrode 25 via the inner conductive film 22, frame 13, resistor R1 and the like.

The index electrode 25 is also electrically connected to a signal outputting electrode 42 in the tube of a capacitor Cf formed by using a part of the funnel 20 via a spring 26. The capacitor Cf is formed in the following manner. A partial area (for example, in a circular or square shape) which is not covered with the inner conductive film 22 and the external conductive film 23 is provided in the funnel 20. In an inner area of the area, circular- or square-shaped signal outputting electrodes 41 and 42 are formed so as to face each other over the funnel 20. The shape of each of the signal outputting electrodes 41 and 42 is not limited to the circle or square but other shapes may be used.

The signal outputting electrode 42 corresponds to an example of "signal outputting electrode" in the invention and the spring 26 corresponds to an example of "pressing member" in the invention.

The signal outputting electrode 41 on the outside of the tube of the capacitor Cf is directly attached to, for example, the outer wall of the funnel 20 by an adhesive or the like. The signal outputting electrode 41 is connected to a signal amplifier AMP1. A signal amplified by the amplifier AMP1 is outputted from an output terminal 43 to processing circuits shown in FIG. 6 which will be described hereinlater. Between the signal outputting electrode 41 of the capacitor Cf and the amplifier AMP1, an input resistor Ri and an input capacitor Ci of the amplifier AMP1 are connected. One end of the input resistor Ri and one end of the input capacitor Ci are connected to the ground. Between the index electrode 25 and the inner conductive film 22 connected to the anode 24, a stray capacitance Cs is generated.

Figures 3A, 3B:
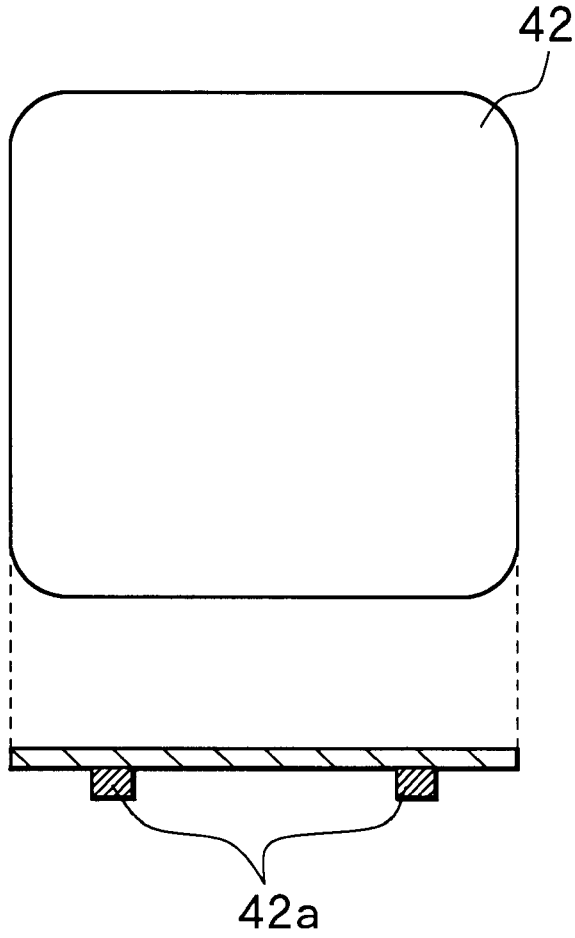
FIGS. 3A and 3B are plan view and cross section showing an example of the construction of a signal outputting electrode in the CRT in FIG. 1.

The signal outputting electrode 42 on the inside of the tube of the capacitor Cf is pressed against and attached to the inner wall of the funnel 20 by the spring 26 as a pressing member. The signal outputting electrode 42 is mounted on the inner wall of the funnel 20 via an intermediate member 42*a* (FIG. 3). The intermediate member 42*a* is provided so that the periphery of the signal outputting electrode 42 is apart from the inner wall of the funnel 20, and has the function of preventing the signal outputting electrode 42 from being adversely influenced by the getter in what is called the gettering process. The intermediate member 42*a* is provided in the area on the inside of the periphery of the signal driving electrode 42 so as not to be adversely influenced by a getter. The intermediate member 42*a* may be provided in accordance with the shape of the periphery of the signal driving electrode 42. For example, the intermediate member 42*a* is provided so as to surround the area inner than the periphery of the signal outputting electrode 42 in a circular or square shape. For example, the intermediate members 42*a* may be partially provided in four positions on the inside corresponding to the four corners of the square-shaped signal outputting electrode 42 in FIG. 3. The material of the intermediate member 42*a* is not particularly limited as long as it does not exert an influence on the signal transmitting function of the signal outputting electrode 42. The action derived by providing the intermediate member 42*a* will be specifically described hereinlater by referring to FIG. 11 and the like.

The spring 26 is, for example, in contact with the area except for the periphery of the signal outputting electrode 42 and presses the signal outputting electrode 42 against the inner wall of the funnel 20. The spring 26 also has the function of transmitting an electric signal from the index electrode 25 to the signal outputting electrode 42 and is made of a conductive substance. For example, besides the spring 26, when a conductive signal transmitting line connecting the signal outputting electrode 42 and the index electrode 25 is provided, the spring 26 does not have to be made of a conductive substance.

The path of the detection signal from the index electrode 25 to the processing circuit outside of the tube will now be described.

When the electron beam eB in the overscan area is incident on and collides with the index electrode 25, the potential is dropped by IbxR(V) from the anode voltage HV (V). In the embodiment, the voltage dropped signal is led as a detection signal to the outside of the tube via the capacitor Cf. Ib denotes a current value which is generated by the passage of the electron beam eB. The CRT functions by a scan with the electron beam eB. In the embodiment, a signal generated by the collision with the index electrode 25 mounted in a specific area in the tube becomes an intermittent signal. It is therefore unnecessary to transfer the detection signal from the index electrode 25 by DC coupling. The detection signal can be led through a transmission line by AC coupling via the capacitor Cf to the processing circuit for image correction outside of the tube.

The capacitance of the capacitor Cf will now be examined. The capacitor Cf is made of a glass material as a dielectric which is the material of the funnel 20 as a component of the envelope of the CRT. The relative dielectric constant $\chi$ of the glass material of the funnel 20 is usually about 6. When it is assumed that the thickness of the glass as a dielectric of the capacitor Cf is 5 mm and the area of each of the signal outputting electrodes 41 and 42 is 4 $cm^2$, since the dielectric constant $\epsilon_0$ of vacuum is $8.85\times10^{-12}$ [C/Vm], the electrostatic capacitance C of the capacitor Cf is obtained as 4.25 pF from $C=\chi\epsilon_0$ S/d. As will be described hereinlater, such a small capacitance is sufficient to perform a process by the image correction processing circuit outside of the tube.

Figure 4:
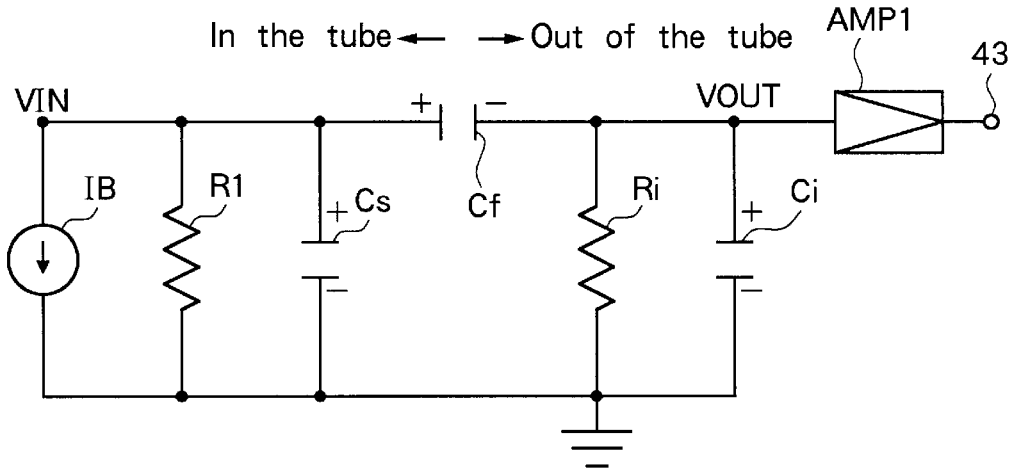
FIG. 4 is a circuit diagram showing the construction of a circuit formed by circuit elements around the index electrode in the CRT in FIG. 1.

The characteristics of the circuits in the signal path of the detection signal from the index electrode 25 will be described. In the circuit diagram shown in FIG. 4, the electron beam eB which collides with the index electrode 25 is expressed as a complete current source IB. In the equivalent circuit shown in the diagram, the current source IB, the resistor R1, a stray capacitance Cs, an input resistor Ri and an input capacitor Ci are connected in parallel in this order, and a capacitor Cf is connected between the stray capacitance Cs and the input resistor Ri. An electrode on the positive side of the capacitor Cf is connected to the current source IB, the resistor R1, and the positive side of the stray capacitance Cs. An electrode on the negative side of the capacitor Cf is connected to the input resistor Ri, the positive side of the input capacitance Ci and the amplifier AMP1.

Figure 5:
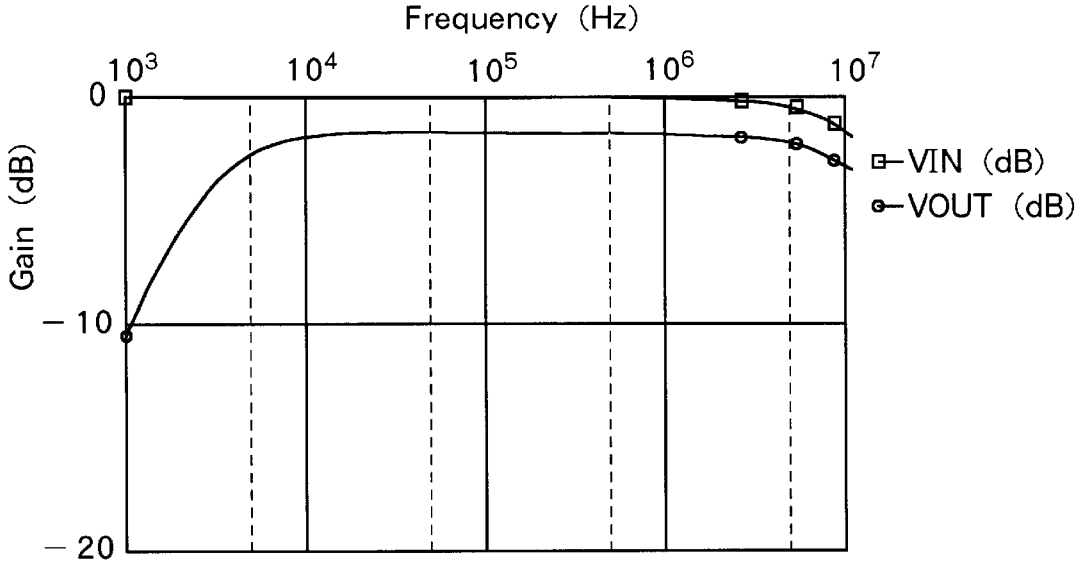
FIG. 5 is a characteristic diagram showing the frequency response of the circuit of FIG. 4.

In FIG. 5, the vertical axis denotes gain (dB) and the lateral axis shows the frequency (Hz). The characteristic diagram is obtained by setting a resistance value of the resistor R1 to 1 kΩ, a capacitance value of the stray capacitance Cs to 10 pF, a capacitance value of the capacitor Cf to 5 pF, a resistance value of the input resistor Ri to 10 MΩ, and a capacitance value of the input capacitor Ci to 1 pF, as an example of characteristic values, in each of circuit elements in an equivalent circuit shown in FIG. 4. From the characteristic diagram, the following is clearly understood. A signal voltage VIN generated in the index electrode 25 starts attenuating in a high frequency band higher than several MHz due to the shunt effect by the capacitance Cs. The low band characteristic of an output voltage VOUT supplied to the amplifier AMP1 is controlled by a cut-off frequency of a high pass filter constructed by the capacitor Cf and the input resistor Ri. At midrange (10 kHz) or higher frequencies, the ratio of the output voltage VOUT to the signal voltage VIN generated by the index electrode 25 is controlled to a voltage ratio between the capacitor Cf and the input capacitance Ci. In the specific example, a signal can be detected with an almost flat frequency response when the frequency lies in a range from a few kHz to about 10 MHz. Since the scan frequency in a regular CRT lies in a range from a few kHz to hundreds kHz, the frequency response is sufficient for the circuit for signal detection.

In the embodiment, as shown in FIG. 1, the index electrodes 25R and 25L are disposed on the right and left sides in the tube. It is also possible to make the electrodes 25L and 25R electrically independent, similarly make the capacitor Cf electrically independent, and derive detection signals from right and left separate signal paths. It is also possible to electrically connect the right and left index electrodes 25R and 25L in the tube and derive a signal from a single capacitor Cf for the following reason. In the CRT, the electron beam eB used for a raster scan does not simultaneously collide with both of the right and left index electrodes 25R and 25L, so that which one of the index electrodes hit by the electron beam eB can be discriminated by the processing circuit outside of the tube. When the right and left index electrodes 25 are electrically connected in the tube, the stray capacitances Cs are increased and the high frequency characteristics deteriorate. When the characteristics are within a permissible range, the construction according to the method of electrically connecting the right and left index electrodes 25R and 25L is simpler.

In the CRT, conventionally, a shielding member called a beam shield having a shape similar to that of the index electrode 25 is disposed to shield the fluorescent screen 11 from the electron beam eB in the overscan area to prevent that the electron beam eB in the overscan area is reflected in the tube and incident on the fluorescent screen 11, thereby causing inadvertent light emission. The index electrode 25 in the embodiment can be also used as a beam shield. Obviously, the index electrode 25 and a beam shield may be separately provided. In this case, for example, the beam shield is disposed between the index electrode 25 and the frame 13.

Figure 6:
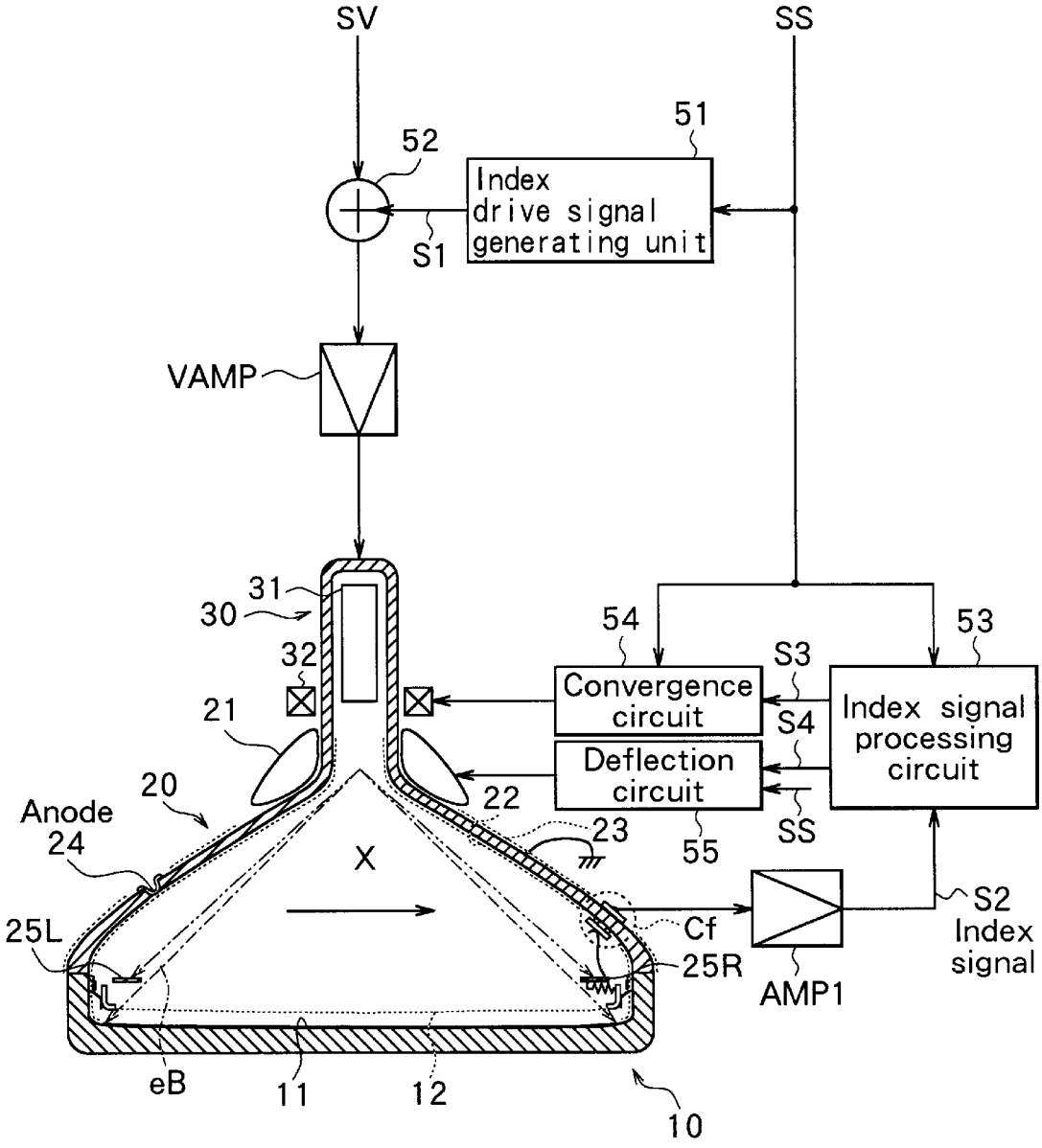
FIG. 6 is a block diagram showing the construction of a signal processing circuit in the CRT in FIG. 1.

The CRT, as shown in FIG. 6, comprises: an index drive signal generating unit 51 to which a sync signal SS is supplied and which generates an index drive signal S1; a mixer 52 for mixing the index drive signal S1 generated by the index drive signal generating unit 51 with a video signal SV supplied and outputting the resultant; a video amplifier VAMP for amplifying an output of the mixer 52; an index signal processing circuit 53 to which an index signal S2 outputted from the amplifier AMP1 and the sync signal SS are supplied and which outputs a convergence correction signal S3 and a deflection correction signal S4; a convergence circuit 54 for controlling the convergence yoke 32 on the basis of the convergence correction signal S3 from the index signal processing circuit 53; and a deflection circuit 55 for controlling the deflection yoke 21 on the basis of the deflection correction signal S4 from the index signal processing circuit 53.

The index drive signal S1 is a signal for a scan with the electron beam eB in the overscan area in which the index electrode 25 is disposed. The index signal S2 corresponds to the detection signal from the index electrode 25. A method of performing image correction by using the signals will be specifically described hereinlater.

The operation of the CRT having the construction will now be described.

The operation as a whole will be described first. In the CRT shown in FIG. 1, an electron beam for each color is emitted from each of the cathodes for R, G and B (not shown) which are disposed in the electron gun 31. The electron beams eB for respective colors emitted from the electron gun 31 are converged by an electromagnetic action of the convergence yoke 32 and is deflected by an electromagnetic action of the deflection yoke 21, thereby scanning the whole fluorescent screen 11 with the electron beam and displaying a desired image in the effective screen area SW on the surface of the panel 10.

When the overscan area OS outside of the effective screen area SW is scanned with the electron beam eB and the electron beam eB hits the index electrode 25, a voltage drop occurs in the index electrode 25. A signal according to the voltage drop is led as a detection signal via the capacitor Cf provided in the funnel 20 to the outside of the tube and the index signal S2 is outputted from the amplifier AMP1. The index signal processing circuit 53 (FIG. 6) outputs the convergence correction signal S3 and the deflection correction signal S4 on the basis of the index signal S2. The convergence circuit 54 controls the convergence yoke 32 on the basis of the convergence correction signal S3. The deflection circuit 55 controls the deflection yoke 21 on the basis of the deflection correction signal S4. Consequently, the scan position of the electron beam eB is controlled and an image distortion and the like are corrected.

Referring to FIGS. 7 to 10, the method of correcting an image on the basis of the index signal S2 will be described more specifically.

Figure 8:
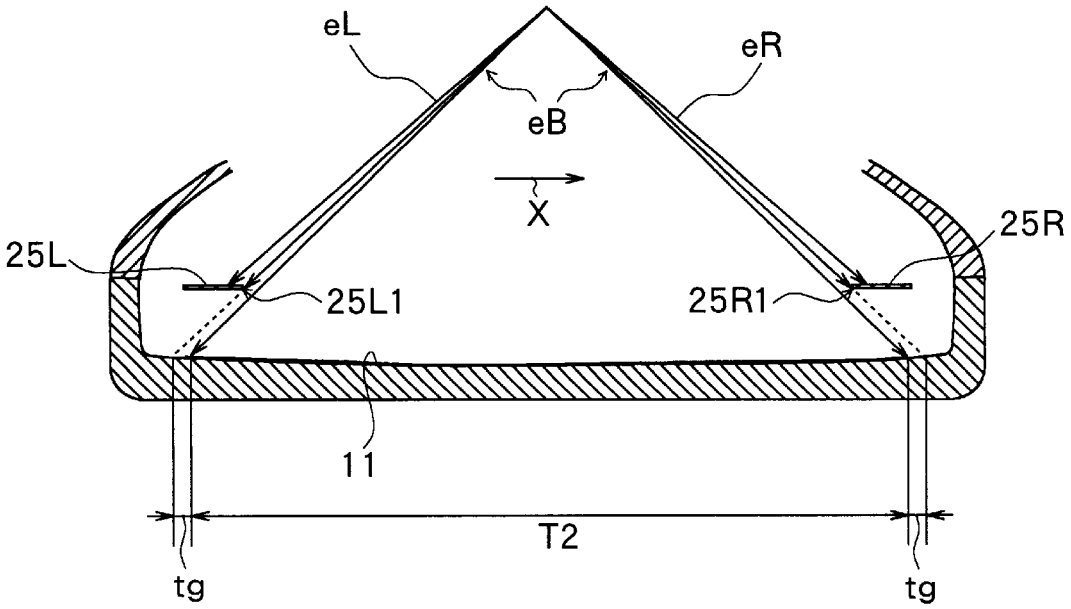
FIG. 8 is a diagram for explaining an image correcting method in the CRT in FIG. 1.
Figure 9:
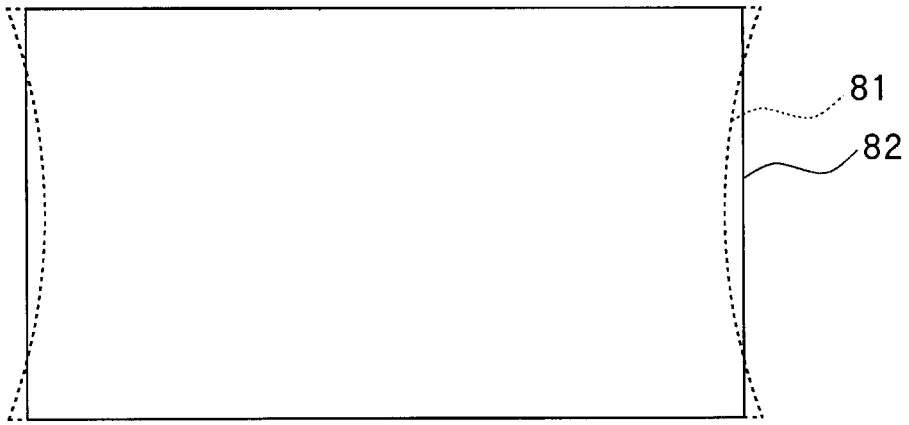
FIG. 9 is a diagram for explaining a scan screen to be corrected in the CRT in FIG. 1.
Figure 10:
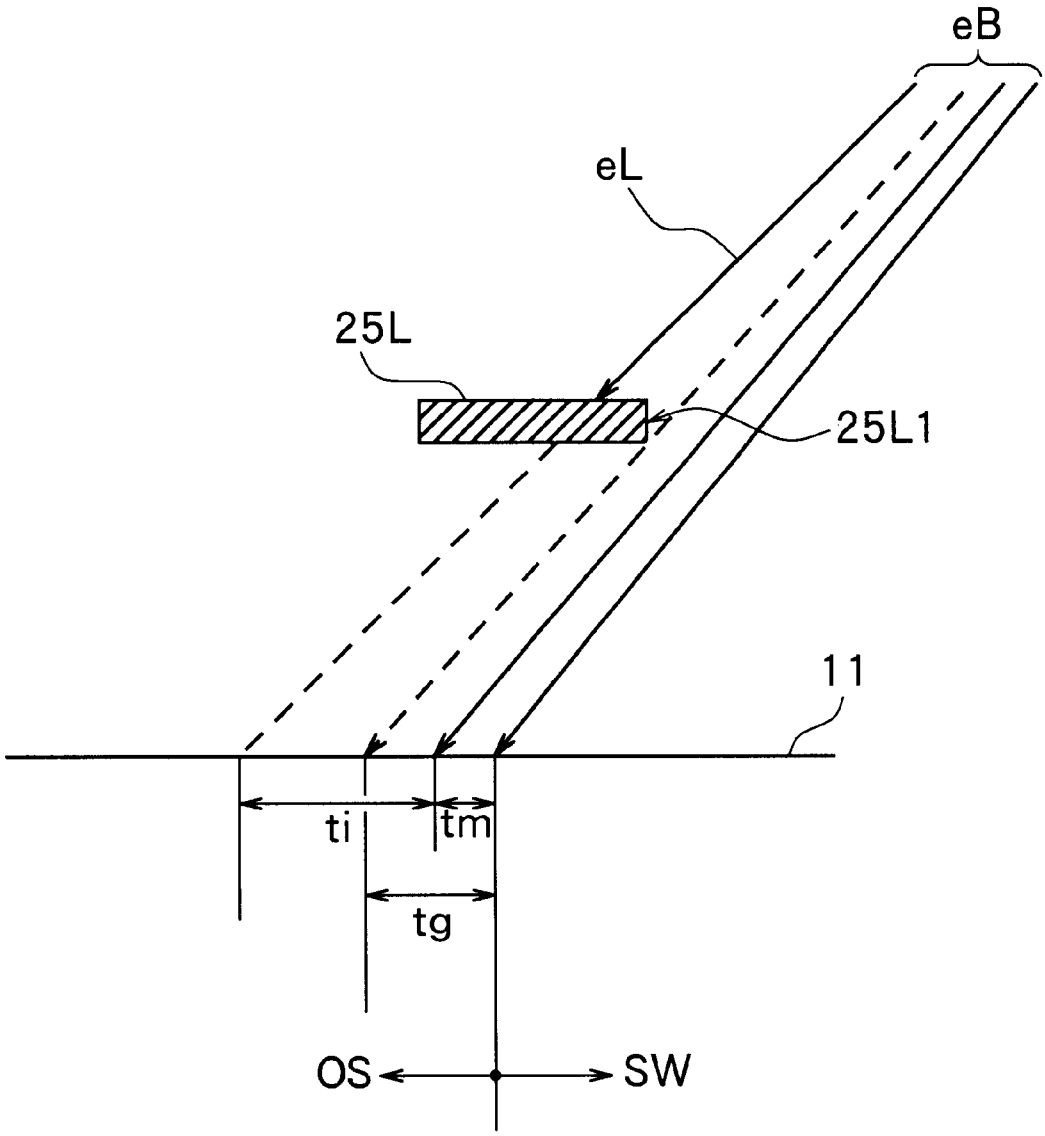
FIG. 10 is a diagram for explaining a scan period of an electron beam in the periphery of the index electrode in the CRT in FIG. 1.

In the following, as shown in FIG. 8, a case of performing a line scan with the electron beam eB in the horizontal direction from left to right (X direction in FIG. 8) and performing a field scan in the vertical direction from top to bottom will be described. In FIG. 8, the left end of the electron beam eB used for the horizontal scan is shown by eL and the right end is shown by eR. In the following, as shown in FIG. 9, a case of performing an image correction so that a scan screen 81 of a pincushion shape is corrected to a proper rectangular scan screen 82 will be described. The scan screen 81 has a narrowed central portion in the horizontal direction and has upper and lower portions stretched in the horizontal direction.

Figures 7A, 7B, 7C, 7D, 7E, 7F, 7G:
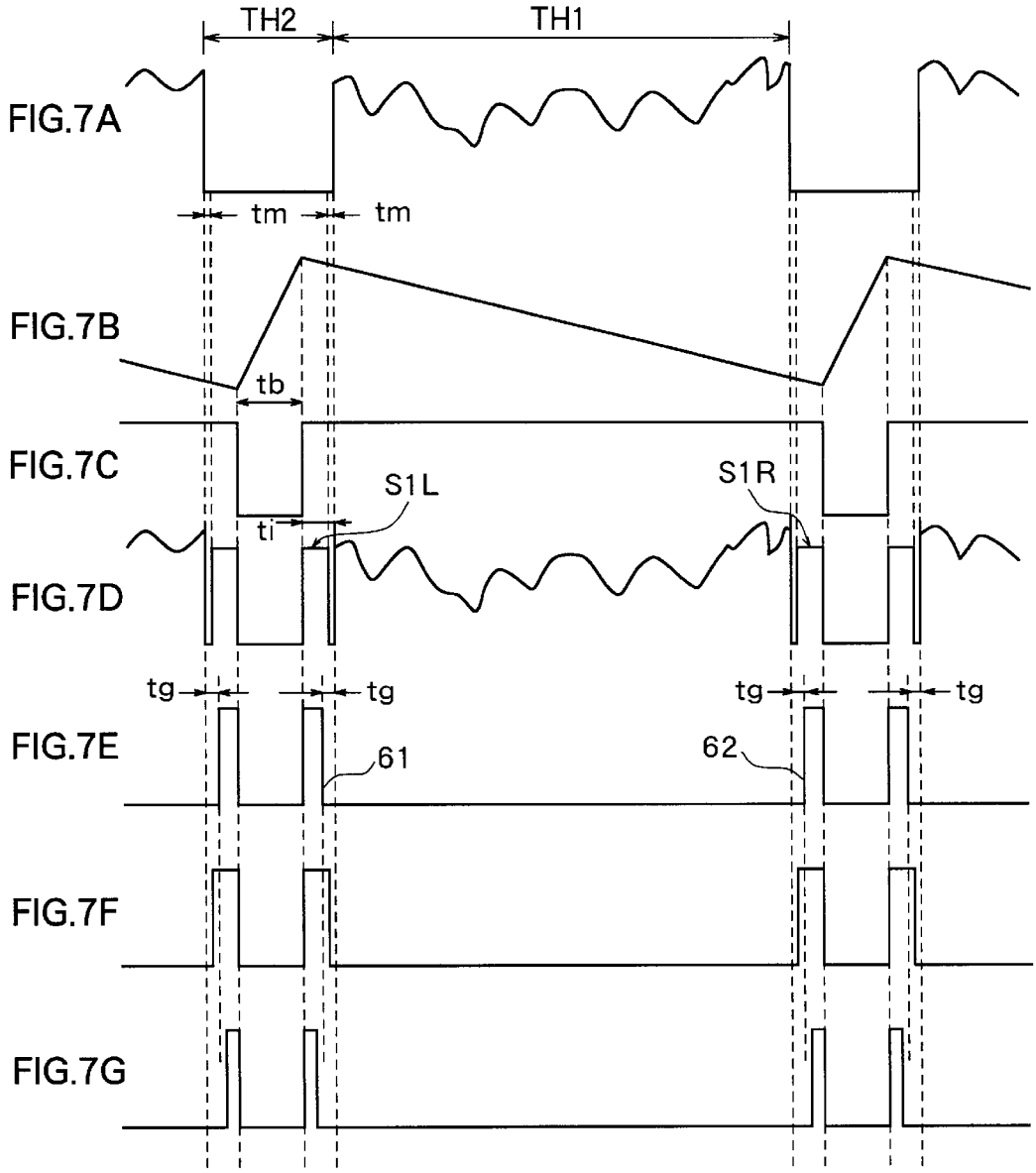
FIGS. 7A to 7G are explanatory diagrams showing waveforms of various signals supplied to processing circuits in the CRT in FIG. 1.

FIG. 7A shows the waveform of the video signal SV supplied to the mixer 52. In the CRT, in a display period TH1 of the video signal SV, the effective screen area SW is scanned with the electron beam eB. A period TH2 is a blanking period of a video image in which no substantial video signal is supplied. FIG. 7B shows the waveform of a horizontal deflection current in the CRT. FIG. 7C shows the waveform of a deflection blanking signal. A period tb corresponds to what is called a retrace period in the horizontal deflection scan.

FIG. 7D shows the waveform of a signal obtained by mixing the video signal SV shown in FIG. 7A with the index drive signal S1 from the index drive signal generating unit 51 (FIG. 6). The resultant signal corresponds to a signal outputted from the mixer 52 (FIG. 6). As described above, the index drive signal S1 is a scan signal of the electron beam eB in the overscan area in which the index electrode 25 is disposed. The index drive signal S1 is a pulse signal obtained by gating a signal having a pulse period (for example, a period of 2×tm) slightly shorter than the period TH2 by the deflection blanking signal shown in FIG. 7C within the video blanking period TH2 shown in FIG. 7A. In FIG. 7D, a pulse signal S1L corresponds to a signal with which the left side overscan area is scanned and a pulse signal S1R corresponds to a signal with which the right side overscan area is scanned. The pulse period of each of the pulse signals S1L and S1R is ti. A period tm is a period in which the electron beam eB is not emitted in practice. The period is a blanking period provided to reduce an influence of the electron beam eB with which the overscan area OS is scanned, exerted on the effective screen area SW.

FIGS. 7E to 7G show the waveforms of the index signal S2 outputted from the amplifier AMP1 on the basis of a signal detected by the index electrode 25 when a scan is performed with the electron beam eB on the basis of the video signal SV including the index drive signal S1 shown in FIG. 7D. The waveform shown in FIG. 7E is an ideal waveform of the index signal S2 to be outputted when a proper deflection scan is performed. The waveform shown in FIG. 7F is of the index signal S2 outputted when the beam is deflected in the direction of widening the screen in the horizontal direction as compared with a proper screen. For example, the screen has widened upper and lower portions like the scan screen 81 of a pincushion shape shown in FIG. 9. In contrast to FIG. 7F, the waveform of FIG. 7G is of the index signal S2 outputted when the beam is deflected in the direction of narrowing the screen in the horizontal direction as compared with a proper screen. For example, the screen has a narrowed central portion of the pincushion shaped scan screen 81 shown in FIG. 9.

The deflection of the electron beam eB is controlled so that the waveform as shown in FIG. 7F or 7G of the index signal S2 becomes the waveform of FIG. 7E. More specifically, the deflection correction signal S4 is transmitted from the index signal processing circuit 53 so that a period between each of an inner edge 61 of the index signal S2 obtained by the left index electrode 25L and an inner edge 62 of the index signal S2 obtained by the right index electrode 25R and the edge of the video blanking signal becomes a predetermined period tg (tg>tm). The amplitude in the horizontal direction and the phase of the deflection circuit 55 are therefore automatically controlled. The operation of the automatic control is performed so that the time from arrival of the electron beam eB at an edge 25L1 or 25R1 on the inner side of the index electrode 25L or 25R provided in the overscan area oS outside of the effective screen area SW to arrival at an area corresponding to the video display period TH1 is controlled to be the predetermined period tg. As a result, the horizontal amplitude and the phase in the deflection circuit 55 are automatically stabilized. Since the CRT can display a color image, the electron beams eB for R, G and B are to be adjusted. When the convergence circuit 54 and the deflection circuit 55 are controlled simultaneously and an adjustment is performed on each of the colors R, G and B, the convergence can be also automatically corrected. By repeating such an automatic control together with the vertical deflection scan every horizontal deflection scan, for example, the image distortion in the pincushion shape like the scan screen 81 shown in FIG. 9 can be corrected over the whole area.

In the above description, detection of the position in one direction (horizontal direction) of the electric beam eB in the overscan area is made possible by using the rectangular index electrodes 25. For example, by forming a notch hole in the index electrode 25, the scan position of the electron beam eB in both the horizontal and vertical directions can be detected. By detecting the scan position of the electron beam eB in the horizontal and vertical directions, image correction in the horizontal and vertical directions can be performed.

Although the example of providing the two index electrodes 25R and 25L in the right and left overscan areas in the tube has been described, further, index electrodes may be provided in the upper and lower overscan areas in the tube. By providing the index electrodes also in the upper and lower overscan areas, the position of the electron beam eB in not only the right and left portions of the scan image but also the upper and lower portions can be detected. It enables an image to be corrected so that the image is displayed more properly.

Since a modification of such index electrodes is disclosed in, for example, Japanese Patent Application No. 11-72658 filed by the applicant of the present invention, further description is omitted here.

A period in which the electron beam eB is controlled on the basis of the index signal S2 can be arbitrarily set. The period can be selected as follows. For example, the control may be performed upon start of the CRT, intermittently at regular intervals, or always. When a construction of what is called a feedback loop such that the correction result of the electron beam eB is reflected at the time of the next field scan with the electron beam eB is employed, even if the mounting position or direction of the CRT is changed during the operation, image distortion and the like due to the change in environment such as earth magnetism can be automatically corrected. Further, also when the scan screen fluctuates due to secular changes in the processing circuits, the fluctuation can be automatically absorbed and a proper image can be displayed. When the operation of the processing circuits is stable and the mounting position is unchanged, it is sufficient to perform correction only upon start of the CRT. As mentioned above, in the embodiment, the influences of the change in environment such as earth magnetism and the secular changes in the processing circuits exerted on a display image can be automatically corrected.

Referring to the cross sections of FIGS. 11A and 11B, the action of the signal outputting electrode 42 as a characteristic of the CRT according to the embodiment will now be described.

Figure 11A:
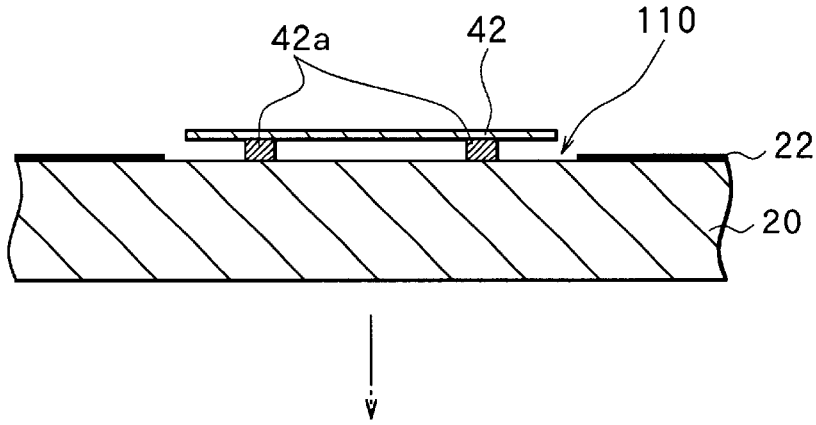
FIGS. 11A and 11B are cross sections for explaining an action of the signal outputting electrode shown in FIG. 3.

FIG. 11A shows the construction of the signal outputting electrode 42 and the periphery before performing a gettering process for maintaining a high vacuum state in the tube. As already described by referring to FIGS. 2 and 3, the embodiment employs the method of mounting the signal outputting electrode 42 via the intermediate member 42*a* onto the area which is not covered with the inner conductive film 22 in a state where the periphery of the signal outputting electrode 42 is apart from the inner wall of the funnel 20. By mounting the signal outputting electrode 42 as mentioned above, an insulating area 110 is provided between the signal outputting electrode 42 and the inner conductive film 22. Consequently, the signal outputting electrode 42 is insulated from the inner conductive film 22. In a state where the signal outputting electrode 42 is mounted as described above, when a substance such as an active metal (for example, barium) is introduced as the getter 100 into the tube, a state as shown in FIG. 11B is resulted.

Figure 11B:
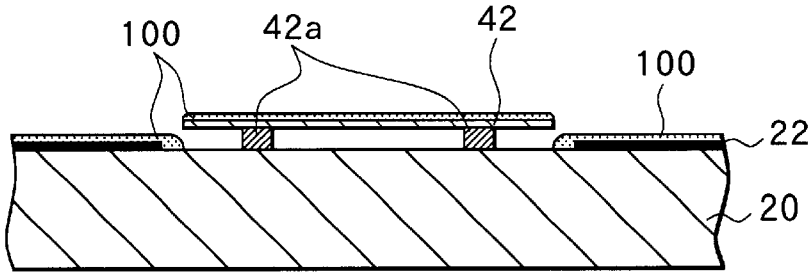

FIG. 11B shows a state of the signal outputting electrode 42 and its periphery after performing the gettering process. As shown in the diagram, by performing the gettering process to splash the getter 100, the getter 100 is adhered onto the signal outputting electrode 42 and the inner conductive film 22. The getter 100 is also partially adhered to the insulating area 110 between the signal outputting electrode 42 and the inner conductive film 22. Depending on the adhering state of the getter 100 in the insulating area 110 (for example, when the getter 100 reaches the intermediate member 42*a*), the signal outputting electrode 42 and the inner conductive film 22 are made conductive. In practice, however, the signal outputting electrode 42 is mounted in a state where the periphery of the signal outputting electrode 42 is apart from the inner wall of the funnel 20 by the intermediate member 42*a*. The intermediate member 42*a* is provided on the inner side of the periphery of the signal outputting electrode 42 so as not to be adversely influenced by the getter. Consequently, the getter 100 is prevented from reaching the intermediate member 42*a*. Thus, it prevents the conduction between the signal outputting electrode 42 and the inner conductive film 22.

Figure 12A:
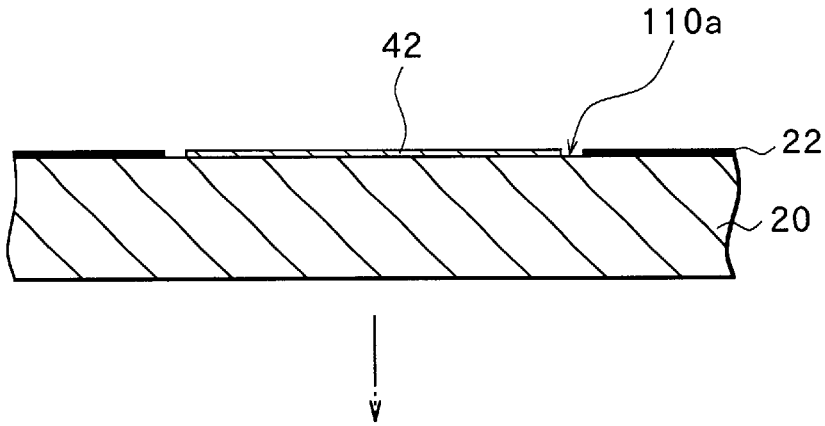
FIGS. 12A and 12B are cross sections for explaining a comparative example of the action of the signal outputting electrode shown in FIGS. 11A and 11B.

Next, a comparative example of the method of mounting the signal outputting electrode 42 in the foregoing embodiment will be descryibed. In the comparative example, as shown in FIG. 12A, the signal outputting electrode 42 is directly mounted on the inner wall of the funnel 20 without using the intermediate member 42*a*. FIG. 12A shows the construction of the signal outputting electrode 42 and its periphery before performing the gettering process. In the state, in a manner similar to the case of FIG.11A, the insulating area 110*a* is provided between the signal outputting electrode 42 and the inner conductive film 22, so that the signal outputting electrode 42 is insulated from the inner conductive film 22. In a state where the signal outputting electrode 42 is mounted as described above, when the getter 100 is introduced into the tube, the state shown in FIG. 12B is resulted.

Figure 12B:
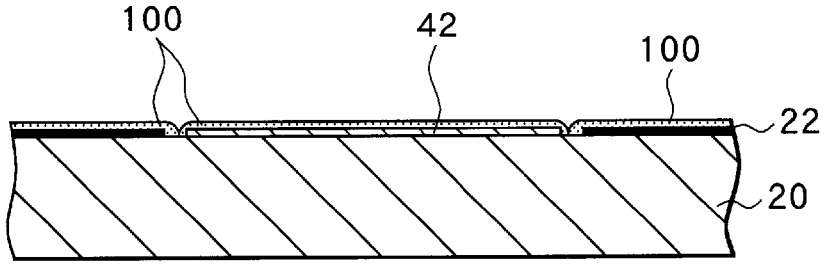

FIG. 12B shows the state of the signal outputting electrode 42 and its periphery after performing the gettering process in the comparative example. As shown in the diagram, by introducing the getter 100 in the gettering process, the getter 100 is adhered onto the signal outputting electrode 42 and the inner conductive film 22. The getter 100 is also adhered to the whole insulating area 110 between the signal outputting electrode 42 and the inner conductive film 22. In the comparative example, consequently, the signal outputting electrode 42 and the inner conductive film 22 are made conductive. When the signal outputting electrode 42 and the inner conductive film 22 are made conductive, a detection signal generated in the envelope cannot be correctly outputted to the outside.

Methods of mounting the signal outputting electrode 42 so as not to be adversely influenced by the getter include not only the above method of using the intermediate member 42*s* but also a method of deforming the electrode itself so as to have a projected part.

Figures 13A, 13B:
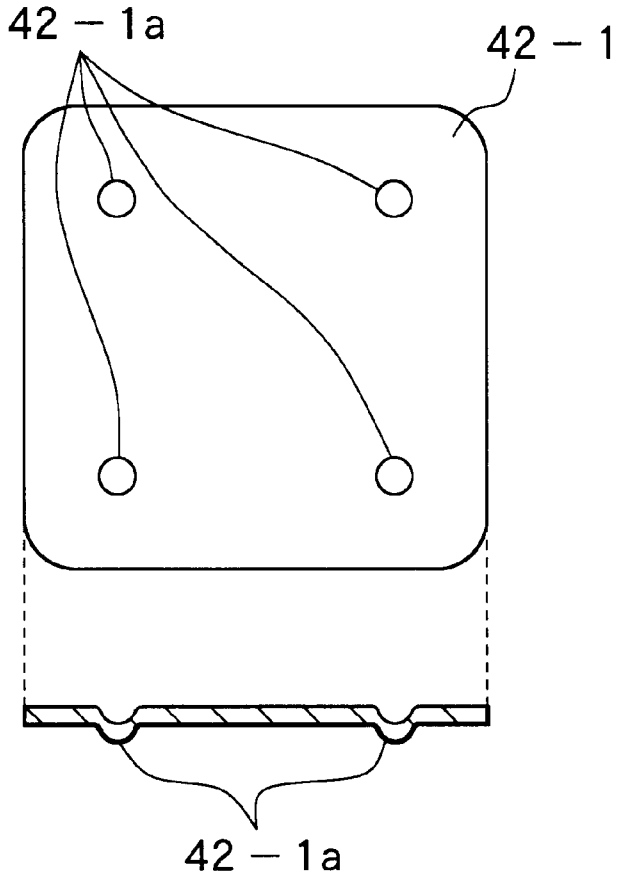
FIGS. 13A and 13B are plan view and cross section showing another example of the construction of the signal outputting electrode.

A signal outputting electrode 42-1 shown in FIG. 13 has projected parts 42-1*a* by, for example, partially pressing the electrode so as to have the function corresponding to the intermediate member 42*a*. As shown in FIG. 13A, the projected parts 42-1*a* are partially provided in only four positions on the inside corresponding to the four corners of the square-shaped signal outputting electrode 42-1. The signal outputting electrode 42-1 is mounted so that the projected parts 42-1*a* are in contact with the inner wall of the envelope. Consequently, in a manner similar to the signal outputting electrode 42, the signal outputting electrode 42-1 can prevent from being adversely influenced by the getter.

The position and the shape of the projected part 42-1*a* are not limited to the above. Another position and another shape can be also used as long as the electrode can be mounted on the inner wall in a state where at least the periphery is apart from the inner wall of the envelope.

Although the projection is partially formed in the area except for the periphery of the electrode in FIGS. 11 and 13, the whole area except for the periphery may be formed in a projection shape. A signal outputting electrode 42-2 shown in FIGS. 14A and 14B relates to an example in which an intermediate member 42-2*a* is provided in the whole area except for the periphery of the electrode to form a projection in the whole area except for the periphery. A signal outputting electrode 42-3 shown in FIG. 15 relates to an example in which a projected part 42-3*a* is formed in the whole area except for the periphery of the electrode by bending or pressing the electrode. In the examples, when the area of the projection (intermediate member 42-2*a* or projected part 42-3*a*) is sufficiently large, for example, the electrode may be mounted only by fixing the projected part to the inner wall of the envelope by using only an adhesive. When sufficient mounting strength cannot be obtained only by the adhesive, in a manner similar to the case of the signal outputting electrode 42 shown in FIG. 2, by pressing the electrode with the spring 26, sufficient mounting strength can be obtained.

As described above, according to the embodiment, the signal outputting electrode 42 is mounted onto the inner wall of the envelope in such a manner that at least the periphery is apart from the inner wall of the envelope. Consequently, the signal outputting electrode 42 can be mounted without being adversely influenced by the getter. Since a projection is partially formed in the electrode by using the intermediate member 42*a* or forming the projected part as the method of mounting the signal outputting electrode 42 in a state where the periphery is apart from the inner wall of the envelope, the method can be carried out at low cost. Further, by pressing the signal outputting electrode 42 with the spring 26 as a pressing member so to be mounted on the inner wall of the envelope, the signal outputting electrode 42 can be securely fixed to the inner wall of the envelope.

According to the embodiment, an electric detection signal from the index electrode 25 generated in the envelope is taken to the outside of the envelope via the signal outputting electrode 42 mounted in the state where at least the periphery of the signal outputting electrode 42 is apart from the inner wall of the envelope. Consequently, the electric detection signal from the index electrode 25 can be preferably outputted to the outside of the tube without being adversely influenced by the getter.

[Second Embodiment]

A second embodiment of the invention will now be described. In the following description, the same components as those of the first embodiment are designated by the same reference numerals and their description is properly omitted.

Although a general CRT for forming a single screen by a single electron gun has been described in the first embodiment, in the second embodiment, a CRT in which a plurality of electron guns are provided, a plurality of partial screens are formed by a plurality of electron beams emitted from the plurality of electron guns, and a single image is formed by connecting the plurality of partial images and is displayed will be described.

Figure 16A:
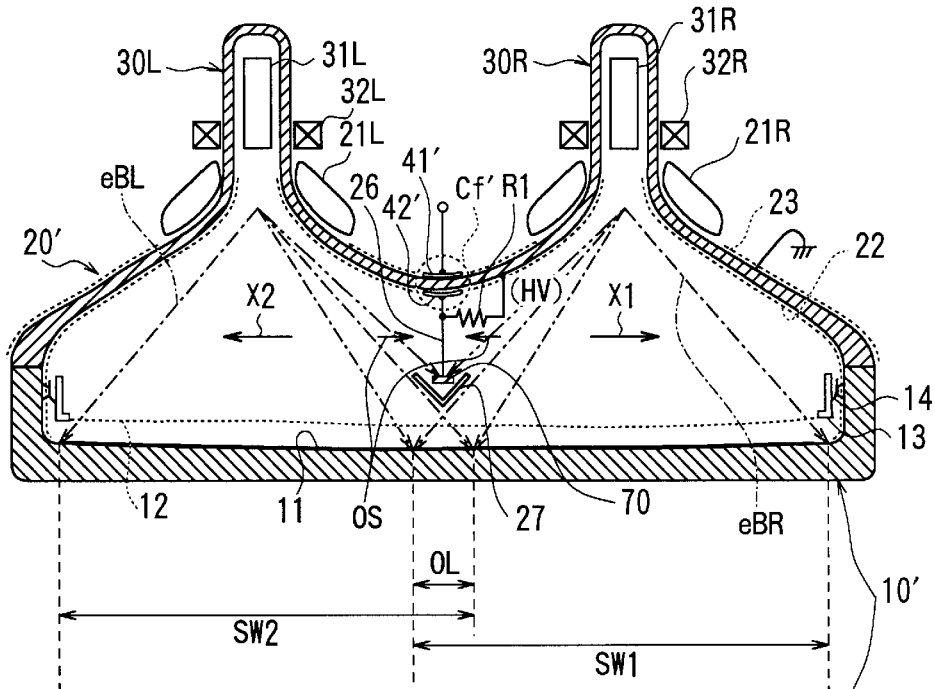
FIGS. 16A and 16B are diagrams schematically showing the construction of a CRT according to a second embodiment of the invention together with an example of a scanning direction of an electron beam.
Figure 16B:
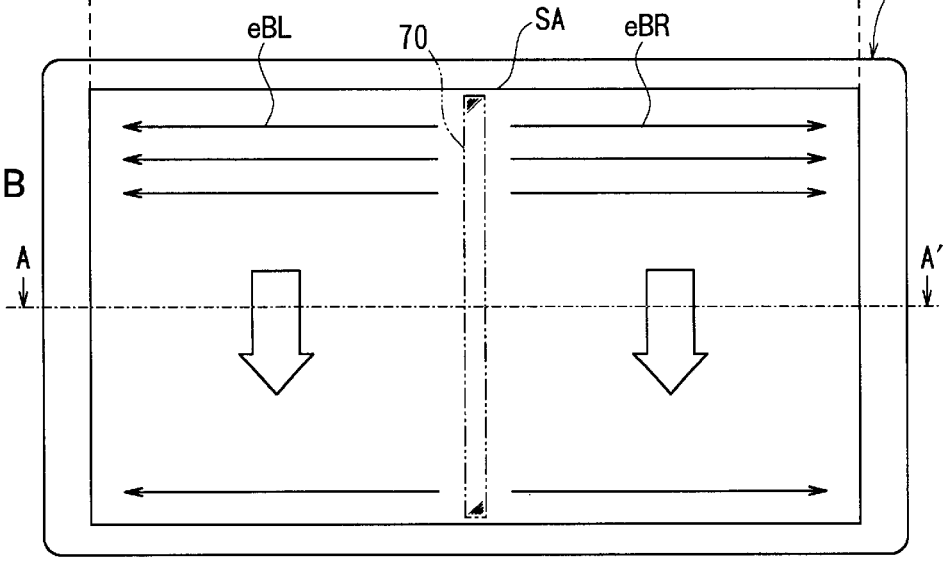

FIG. 16B is a front view of the CRT. FIG. 16A is a cross section taken along line A–A' of FIG. 16B. The CRT according to the embodiment comprises: a panel 10' in which the fluorescent screen 11 is formed; and a funnel 20' formed integrally with the panel 10'. On the right and left rear portions of the funnel 20', elongated two necks 30R and 30L having therein electron guns 31R and 31L are formed. The CRT has two funnel-shaped envelopes by the panel 10', funnel 20' and necks 30L and 30R.

Although not shown, in a manner similar to the electron gun 31 in FIG. 1, each of the electron guns 31L and 31R has a construction in which a plurality of electrodes are arranged in the front part of a hot cathode structure having three cathodes for red (R), green (G) and blue (B). Control, acceleration, and the like of electron beams eBL and eBR emitted from the cathodes are performed by each of the electrodes. Electron beams for respective colors emitted from the electron guns 31L and 31R pass through the color selecting mechanism 12 and the like and are incident on phosphors of corresponding colors in the fluorescent screen 11.

In the CRT, about left half of an image is drawn by the electron beams eBL emitted from the electron gun 31L disposed on the left side and about right half of the image is drawn by the electron beams eBR emitted from the electron gun 31R disposed on the right side. By partially overlapping and connecting the ends of the right and left partial images, a single image SA as a whole is formed and is displayed. The central part of the image SA formed as a whole corresponds to an area OL in which the right and left partial images are overlapped with each other. The fluorescent screen 11 in the overlapping area OL is shared by the electron beams eBL and eBR.

FIG. 16B shows an example of scan directions of the electron beams eBL and eBR. A line scan of the electron beam eBL from the left electron gun 31L is performed from right to left in the horizontal deflection direction (X2 direction in FIG. 16A). A field scan is performed from top to bottom in the vertical deflection direction. In FIG. 16B, a line scan of the electron beam eBR from the right electron gun 31R is performed from left to right in the horizontal deflection direction (X1 direction in FIG. 16A) and a field scan is performed from top to bottom in the vertical deflection direction. In the example shown in FIG. 16B, the line scan by the electron beams eBL and eBR are performed in the opposite directions from the center of the screen toward the outer sides in the horizontal direction and the field scan is performed from top to bottom as in a general CRT.

Figure 17:
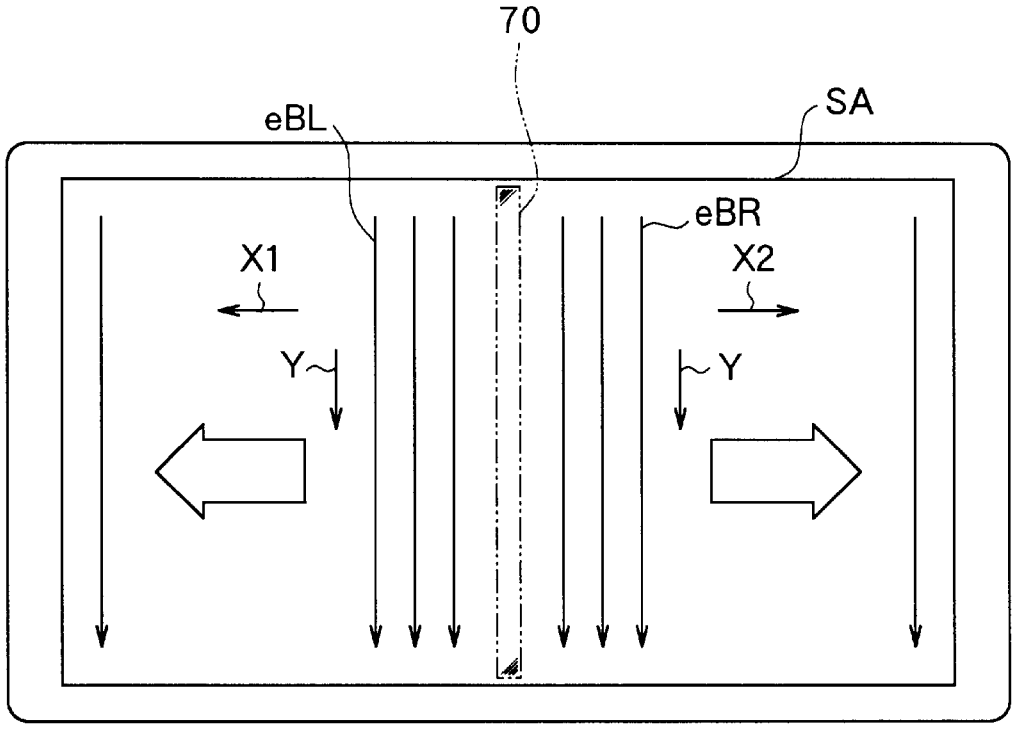
FIG. 17 is a diagram for explaining another example of the scanning direction of an electron beam in the CRT according to the second embodiment of the invention.

For example, as shown in FIG. 17, the scan directions of the electron beams eBL and eBR different from those shown in FIG. 16B may be also used. In the example of FIG. 16B, the line scan by the electron beams eBL and eBR is performed in the horizontal direction and the field scan is performed from top to bottom. In the example of FIG. 17, the line scan by the electron beams eBL and eBR is performed from top to bottom (Y direction in the diagram) and the field scan is performed in opposite directions (X1 and X2 directions in the diagram) from the center of the screen to the outer sides in the horizontal direction. In the example shown in FIG. 17, the line scan and the field scan with the electron beams eBL and eBR are performed in the directions opposite to those of the example shown in FIG. 16B.

In the CRT, in the overscan area OS of the electron beams eBL and eBR in the connection of the right and left neighboring partial screens (center of the whole screen in the embodiment), an index electrode 70 having a rectangular plate shape is provided so as to face the fluorescent screen 11. Further, between the index electrode 70 and the fluorescent screen 11 in the CRT, a V-shaped beam shield 27 as a shielding member from the electron beams eBL and eBR is disposed to prevent the electron beams eBL and eBR in the overscan area OS from arriving at the fluorescent screen 11 to inadvertently cause light emission. The beam shield 27 is suspended, for example, by using the frame 13 for supporting the color selecting mechanism 12 as a base. The beam shield 27 is electrically connected to the inner conductive film 22 via the frame 13, so that the anode voltage HV is applied. In the embodiment, the index electrode 70 corresponds to an example of "electron beam detecting means" in the invention.

Although not shown, a plurality of notch holes are formed in the longitudinal direction in the index electrode 70. The index electrode 70 outputs electric detection signals according to the incident electron beams eBL and eBR. The detection signal generated from the index electrode 70 is supplied to the processing circuit for image correction outside of the tube and is used mainly to control image data in the connection part of the electron beams eBL and eBR.

The overscan area denotes an area outside of the areas scanned with the electron beams eBL and eBR which form an effective screen. In FIGS. 16A and 16B, the area SW1 denotes an effective screen on the fluorescent screen 11 in the horizontal direction of the electron beam eBR and the area SW2 denotes an effective screen on the fluorescent screen 11 in the horizontal direction of the electron beam eBL.

The index electrode 70 is made of a conductive substance such as a metal. For example, the index electrode 70 is suspended via an insulating material (not shown) by using the frame 13 as a base. The index electrode 70 is electrically connected to the resistor R1 connected to the inner face of the funnel 20. The anode voltage VH is applied to the index electrode 70 via the inner conductive film 22, resistor Ri and the like. The index electrode 70 is also electrically connected to an electrode 42' on the inside of the tube of a capacitor Cf' formed by using a part of the funnel 20' via the spring 26.

Figure 2:
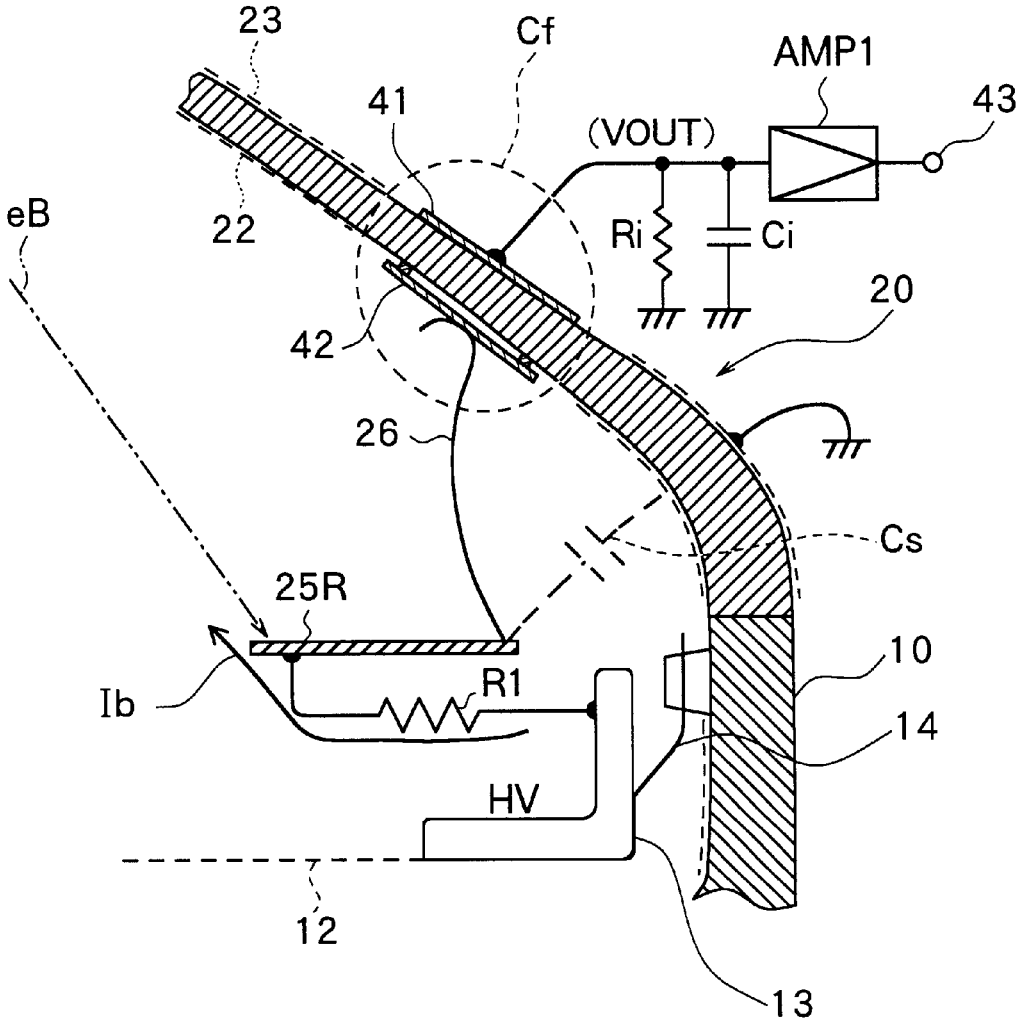
FIG. 2 is an enlarged cross section of an index electrode and its periphery in the CRT shown in FIG. 1.

A method of forming the capacitor Cf' is similar to that of the capacitor Cf described by referring to FIG. 2 in the first embodiment. In the funnel 20', an area which is not covered with the inner conductive film 22 and the external conductive film 23 is partially provided. In an inner area of the area, for example, signal outputting electrodes 41' and 42' are formed so as to face each other over the funnel 20'.

In a manner similar to the first embodiment, the signal outputting electrode 42' on the inside of the tube is mounted on the inner wall of the envelope in such a manner that at least the periphery is apart from the inner wall of the envelope, so that the signal outputting electrode is not adversely influenced by the getter to be introduced in the gettering process. In a manner similar to the first embodiment, the signal outputting electrode 42' is attached in a state that the periphery is apart from the inner wall of the envelope by using the intermediate member 42*a* or by partially projecting the electrode.

Since such a multiple electron gun type CRT has been disclosed in, for example, Japanese Patent Application No. 11-144967 filed by the applicant of the present invention, further description is omitted here.

As described above, according to the embodiment, in a manner similar to the first embodiment, in the multiple electron gun type CRT, the signal outputting electrode 42' can be mounted without being adversely influenced by the getter. An electric detection signal from the index electrode 25 can be outputted to the outside of the tube without being adversely influenced by the getter.

The other construction, action and effects in the second embodiment are similar to those of the first embodiment.

The invention is not limited to the foregoing embodiments but can be variously modified. For example, although the CRT capable of displaying a color image has been described in the embodiments, the invention can be also applied to a CRT for displaying a monochromatic image. Although the example of providing the signal outputting electrode 42 or 42' in the funnel 20 or 20' has been described in each of the embodiments, the position of forming the signal outputting electrode 42 or 42' may be another part (for example, in the panel 10 or 10') as long as it is in the envelope of the CRT. Further, although the electrode for outputting a signal from the index electrode 25 or 25' for detecting the position of the electron beam has been described in each of the embodiments, the invention can be also applied to an electrode for outputting a signal from the inside of the tube for another purpose.

As the method of mounting the signal outputting electrode, methods other than the methods represented in the embodiments may be also employed as long as the signal outputting electrode can be mounted to the inner wall of the envelope in a state where at least its periphery is apart from the inner wall of the envelope.

Although the CRT which has two electron guns and forms a single screen by connecting two scan screens has been described in the second embodiment, the invention can be also applied to a CRT which has three or more electron guns and forms a single screen by connecting three or more scan screens. In the second embodiment, the partial screens are partially overlapped with each other to thereby obtain a single screen. A single screen may be also obtained by simply linearly connecting the ends of partial screens without using the overlapped area.

In the second embodiment, as shown in FIG. 16, the line scans with the electron beams eBL and eBR are performed in opposite directions from the center of the screen toward the outer sides and the field scan is performed from top to bottom like a general CRT. The invention is not limited to the scan directions of the electron beams eBL and eBR. For example, the line scans can be performed from the outer sides to the center of the screen. Although the field scans with the electron beams eBL and eBR are performed in opposite directions from the center to the outer sides in the second embodiment, as shown in FIG. 17, for example, the field scan can be also performed from the outer sides to the center of the screen. The scan with the electron beams eBL and eBR can be also performed in the same direction.

Obviously many modifications and variations of the present invention are possible in the light of the above teachings. It is therefore to be understood that within the scope of the appended claims the invention may be practiced otherwise than as specifically described.

What is claimed is:

1. A method of mounting a signal outputting electrode onto an envelope, the signal outputting electrode to be used for outputting an electric signal generated in the envelope of a cathode ray tube to the outside of the envelope, including the steps of:

mounting the signal outputting electrode on an inner face of the envelope in such a manner that at least the periphery of the signal outputting electrode is apart from the inner wall of the envelope; and, introducing a getter into the envelope.

2. The method of mounting the signal outputting electrode in the cathode ray tube according to claim 1, wherein a projected part is formed in an area except for the periphery of the signal outputting electrode so as to be in contact with the inner wall of the envelope, thereby making at least the periphery of the signal outputting electrode apart from the inner wall of the envelope.

3. The method of mounting the signal outputting electrode in the cathode ray tube according to claim 2, wherein the projected part in the signal outputting electrode is formed by partially bending or pressing the signal outputting electrode.

4. The method of mounting the signal outputting electrode in the cathode ray tube according to claim 1, wherein an intermediate member is provided between the signal outputting electrode, except for the periphery of the signal outputting electrode, and the inner wall of the envelope, and the signal outputting electrode is mounted onto the inner wall of the envelope via the intermediate member.

5. The method of mounting the signal outputting electrode in the cathode ray tube according to claim 1, wherein the signal outputting electrode is mounted on the inner wall of the envelope by being pressed with a pressing member.

6. The method of mounting the signal outputting electrode in the cathode ray tube according to claim 1, wherein the cathode ray tube comprises:

an electron gun for emitting an electron beam with which an effective screen and an overscan area outside of the effective screen are scanned; and electron beam detecting means which is provided in the overscan area of the electron beam and generates an electric detection signal according to the incident electron beam, wherein the signal outputting electrode and the electron beam detecting means are electrically connected to each other so that the detection signal generated by the electron beam detecting means can be outputted as the electric signal to the outside of the envelope.

7. The method of mounting the signal outputting electrode in the cathode ray tube according to claim 6, wherein the cathode ray tube has a plurality of electron guns for emitting a plurality of electron beams, forms a plurality of partial screens by performing scans with the plurality of electron beams emitted from the electron guns, and forms a single screen by connecting the plurality of partial screens.

8. A signal outputting method in a cathode ray tube, including the steps of:

mounting a signal outputting electrode to be used for outputting an electric signal generated in an envelope of the cathode ray tube mounted on an inner face of the envelope in a manner such that at least the periphery of the signal outputting electrode is apart from the inner wall of the envelope; and, outputting the electric signal generated in the envelope to the outside of the envelope via the signal outputting electrode mounted on the inner wall of the envelope.

9. The signal outputting method in the cathode ray tube according to claim 8, wherein a projected part is formed in an area except for the periphery of the signal outputting electrode so as to be in contact with the inner wall of the envelope, thereby making at least the periphery of the signal outputting electrode apart from the inner wall of the envelope.

10. The signal outputting method in the cathode ray tube according to claim 9, wherein the projected part in the signal outputting electrode is formed by partially bending or pressing the signal outputting electrode.

11. The signal outputting method in the cathode ray tube according to claim 8, wherein an intermediate member is provided between the signal outputting electrode, except for the periphery of the signal outputting electrode, and the inner wall of the envelope, and the signal outputting electrode is mounted onto the inner wall of the envelope via the intermediate member.

12. The signal outputting method in the cathode ray tube according to claim 8, wherein the signal outputting electrode is mounted onto the inner wall of the envelope by being pressed with a pressing member.

13. The signal outputting method in the cathode ray tube according to claim 8, wherein the cathode ray tube comprises:

an electron gun for emitting an electron beam with which an effective screen and an overscan area outside of the effective screen are scanned; and electron beam detecting means which is provided in the overscan area of the electron beam and generates an electric detection signal according to the incident electron beam, wherein the signal outputting electrode and the electron beam detecting means are electrically connected to each other so that the detection signal generated by the electron beam detecting means can be outputted as the electric signal to the outside of the envelope via the signal outputting electrode.

14. The signal outputting method in the cathode ray tube according to claim 13, wherein the cathode ray tube has a plurality of electron guns for emitting a plurality of electron beams, forms a plurality of partial screens by performing scans with the plurality of electron beams emitted from the plurality of electron guns, and forms a single screen by connecting the plurality of partial screens.

15. A cathode ray tube comprising:

an envelope;

a light emitting portion for emitting light in accordance with a scan with an electron beam emitted in the envelope; and a signal outputting electrode which is mounted on an inner wall of the envelope in such a manner that at least the periphery is apart from the inner wall of the envelope and which outputs an electric signal generated in the envelope to the outside of the envelope.

16. The cathode ray tube according to claim 15, further comprising:

an electron gun for emitting an electron beam with which an effective screen and an overscan area outside of the effective screen are scanned; and electron beam detecting means which is provided in the overscan area of the electron beam and generates an electric detection signal according to the incident electron beam, wherein the signal outputting electrode is electrically connected to the electron beam detecting means and has the function of outputting the detection signal generated by the electron beam detecting means as the electric signal to the outside of the envelope.

17. The cathode ray tube according to claim 16, further comprising:

a plurality of electron guns for emitting a plurality of electron beams, wherein a plurality of partial screens are formed by performing scans with the plurality of electron beams emitted from the plurality of electron guns and a single screen is formed by connecting the plurality of partial screens.

* * * * *